US008215751B2

(12) United States Patent
Petruchik et al.

(10) Patent No.: US 8,215,751 B2
(45) **Date of Patent: *Jul. 10, 2012**

(54) CARRIAGE WITH IMPROVED PRINT CARTRIDGE MOUNTING RELIABILITY

(75) Inventors: Dwight J. Petruchik, Honeoye Falls, NY (US); James J. Haflinger, San Diego, CA (US); Arthur K. Wilson, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 351 days.

This patent is subject to a terminal disclaimer.

(21) Appl. No.: 12/620,611

(22) Filed: Nov. 18, 2009

(65) Prior Publication Data

US 2011/0115860 A1 May 19, 2011

(51) Int. Cl.
*B41J 2/14* (2006.01)

(52) U.S. Cl. ..... 347/49

(58) Field of Classification Search ..... 347/49, 347/50, 86

See application file for complete search history.

(56) References Cited

U.S. PATENT DOCUMENTS

| | | | | |
|---|---|---|---|---|
| 6,203,147 | B1 * | 3/2001 | Battey et al. | 347/86 |
| 6,302,535 | B1 * | 10/2001 | Sturgeon et al. | 347/86 |
| 6,322,205 | B1 | 11/2001 | Childers et al. | |
| 6,796,646 | B2 * | 9/2004 | Komplin et al. | 347/86 |
| 6,955,422 | B2 * | 10/2005 | Miyazawa et al. | 347/86 |
| 7,008,053 | B2 * | 3/2006 | Hashii et al. | 347/86 |
| 2008/0151032 | A1 | 6/2008 | Trafton et al. | |
| 2011/0115858 | A1 * | 5/2011 | Petruchik et al. | 347/86 |

* cited by examiner

*Primary Examiner* — Anh T. N. Vo
(74) *Attorney, Agent, or Firm* — Peyton C. Watkins

(57) ABSTRACT

An inkjet carriage that receives a print cartridge, the inkjet carriage includes a holding receptacle having a wall, wherein the holding receptacle is configured to receive the print cartridge; and a spring disposed on the wall of the holding receptacle to provide a biasing force in a direction that pushes the print cartridge away from the wall of the inkjet carriage and which biasing force must be manually overcome in order to properly install the print cartridge in the holding receptacle of the inkjet carriage.

7 Claims, 5 Drawing Sheets

CARRIAGE WITH IMPROVED PRINT CARTRIDGE MOUNTING RELIABILITY

CROSS-REFERENCE TO RELATED APPLICATION

Reference is made to commonly assigned, copending U.S. patent application Ser. No. 12/620,614, filed Nov. 18, 2009 by Dwight J. Petruchik, et al., entitled "Printhead with Improved Ink Tank Mounting Reliability", and commonly assigned U.S. patent application Ser. No. 12/620,619, filed Nov. 18, 2009 by Dwight J. Petruchik, et al, entitled "Ink Tank Feature for Improved Mounting Reliability".

FIELD OF THE INVENTION

The present invention relates generally to a carriage for an inkjet printer, and more particularly to the mounting of a detachably mountable printhead to the carriage.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge, so that the printhead needs to be replaced when the ink is depleted, or the ink tank can be detachably mounted to the printhead so that only the ink tank itself needs to be replaced when the ink tank is depleted. Carriage mounted ink supplies typically contain only enough ink for up to about several hundred prints. This is because the total mass of the carriage needs be limited so that accelerations of the carriage at each end of the travel do not result in large forces that can shake the printer back and forth. As a result, users of carriage printers need to replace print cartridges periodically depending on their printing usage, typically several times per year. Consequently, the task of replacing a detachably mounted print cartridge must be simple and must consistently achieve a proper engagement of the print cartridge with the carriage. Otherwise, improper mounting of the print cartridge can lead to misalignment of the nozzle arrays with respect to the media advance direction causing jaggedness in printed images. In addition an improperly mounted print cartridge can have intermittent electrical contact with printer, which results in poor image quality or even damage to the print cartridge.

US Patent Application Publication 2008/0151032, incorporated herein by reference, discloses an ink tank having a data storage device mounted on a pedestal such that the pedestal can extend through an opening in a supporting structure of the printhead. As such, when the printhead is mounted on the carriage, and the ink tank is installed in the printhead, the data storage device on the ink tank pedestal makes contact with an electrical connector on the carriage. As a result, the printer can detect that an ink tank has been installed. In an analogous fashion, a print cartridge can have a device or electrical contacts to make contact with an electrical connector on the carriage so that the printer senses installed print cartridges. However, on some occasions, it is found that the user accidentally does not fully press the print cartridge into its latched position on the carriage, but the data storage device still touches the electrical contact on the carriage. Thus, the printer falsely detects a properly installed print cartridge, when in fact the print cartridge is improperly installed.

What is needed is a user-friendly mounting configuration that eliminates false indications of print cartridge installations while enabling reliable detection of properly mounted print cartridges.

SUMMARY OF THE INVENTION

The present invention is directed to overcoming one or more of the problems set forth above. Briefly summarized, according to one aspect of the invention, the invention resides in an inkjet carriage that receives a print cartridge, the inkjet carriage comprises a holding receptacle having a wall, wherein the holding receptacle is configured to receive the print cartridge; and a spring disposed on the wall of the holding receptacle to provide a biasing force in a direction that pushes the print cartridge away from the wall of the inkjet carriage and which biasing force must be manually overcome in order to properly install the print cartridge in the holding receptacle of the inkjet carriage.

DETAILED DESCRIPTION OF THE INVENTION

Figure 1:
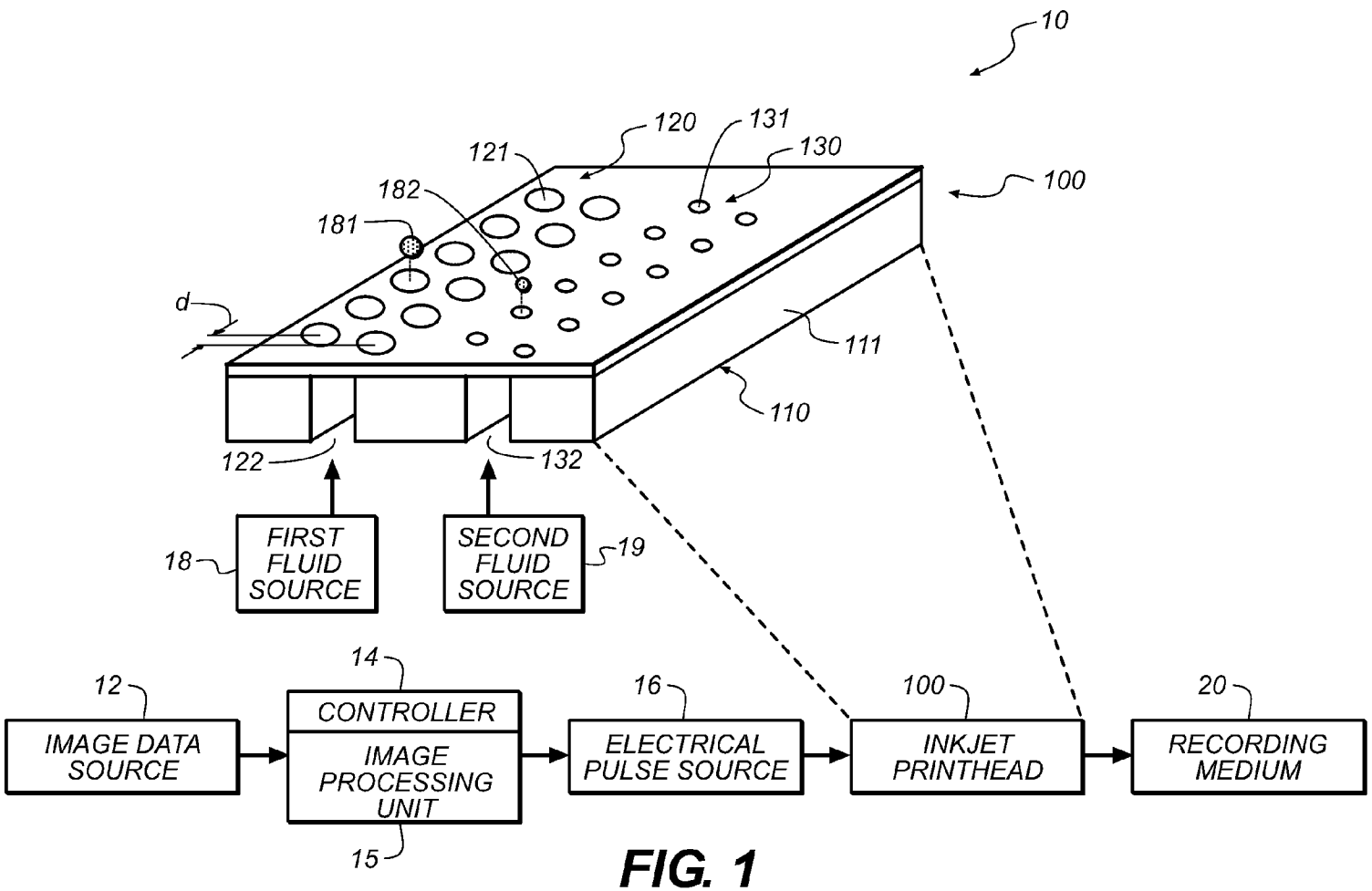
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and the controller 14 outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, and the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
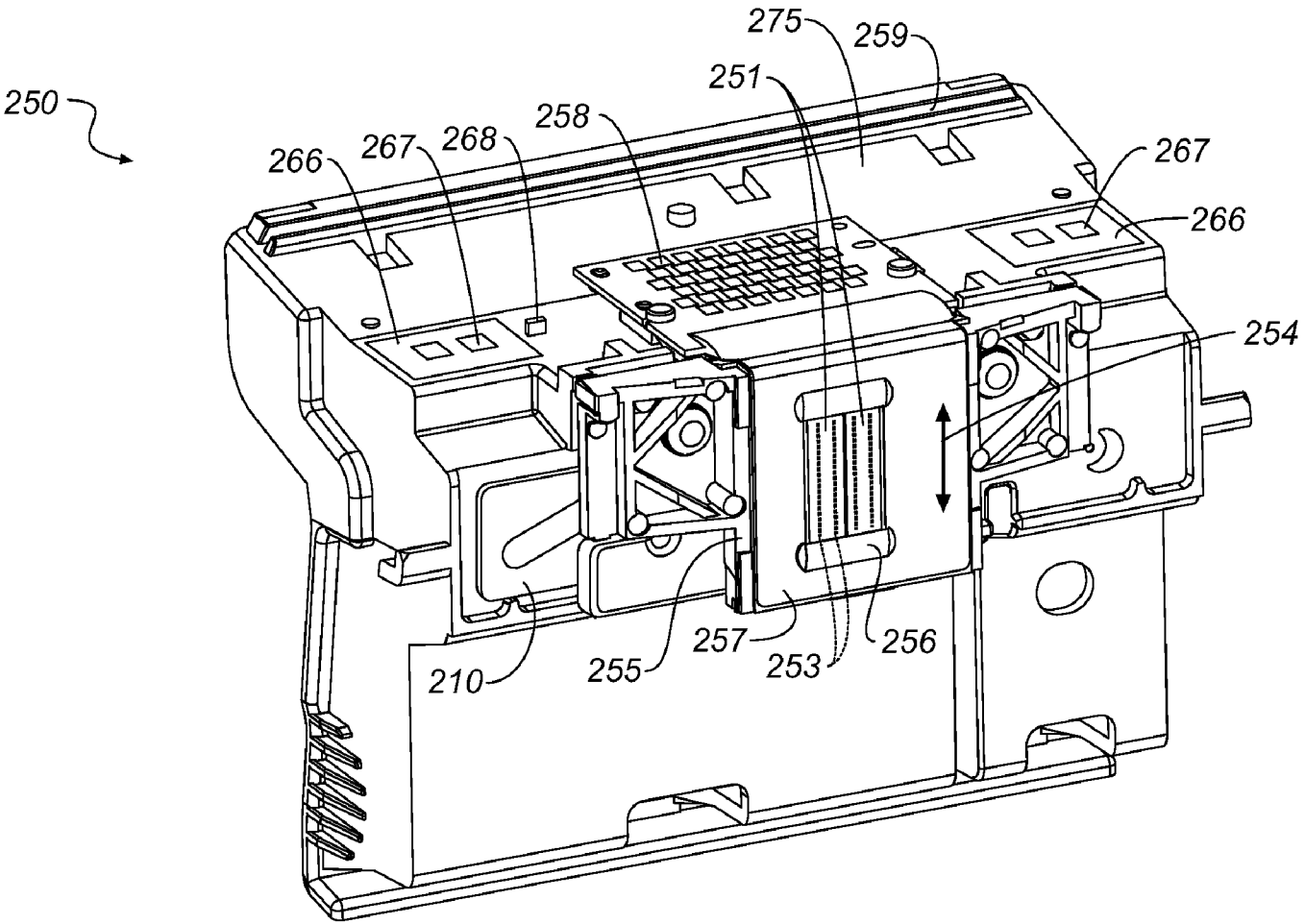
FIG. 2 is a perspective view of a portion of a printhead.

FIG. 2 shows a perspective view of a portion of a print cartridge 250, which is an example of an inkjet printhead 100 plus ink sources 18 and 19. Print cartridge 250 includes two printhead die 251 (similar to printhead die 110 in FIG. 1) that are affixed to mounting substrate 255. Each printhead die 251 contains two nozzle arrays 253 so that print cartridge 250 contains four nozzle arrays 253 altogether. The four nozzle arrays 253 in this example are each connected to ink sources (not shown in FIG. 2), such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving print cartridge 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of print cartridge 250 and connects to connector board 258 on rear wall 275. A lip 259 on rear wall 275 serves as a catch for latching print cartridge 250 into carriage 200 at latch 249 (see FIGS. 3 and 5). When print cartridge 250 is mounted into the carriage 200 (see FIGS. 3 and 5), connector board 258 is electrically connected to a connector 244 (FIG. 5) on the carriage 200 so that electrical signals can be transmitted to the printhead die 251. Print cartridge 250 also includes two devices 266 mounted on rear wall 275. When print cartridge 250 is properly installed into the carriage of a carriage printer, electrical contacts 267 will make contact with an electrical connector on the carriage. Raised engagement feature 268 is configured to engage a spring to prevent electrical contacts 267 from making contact with the electrical connector until the print cartridge 250 is properly installed, as described below.

Figure 3:
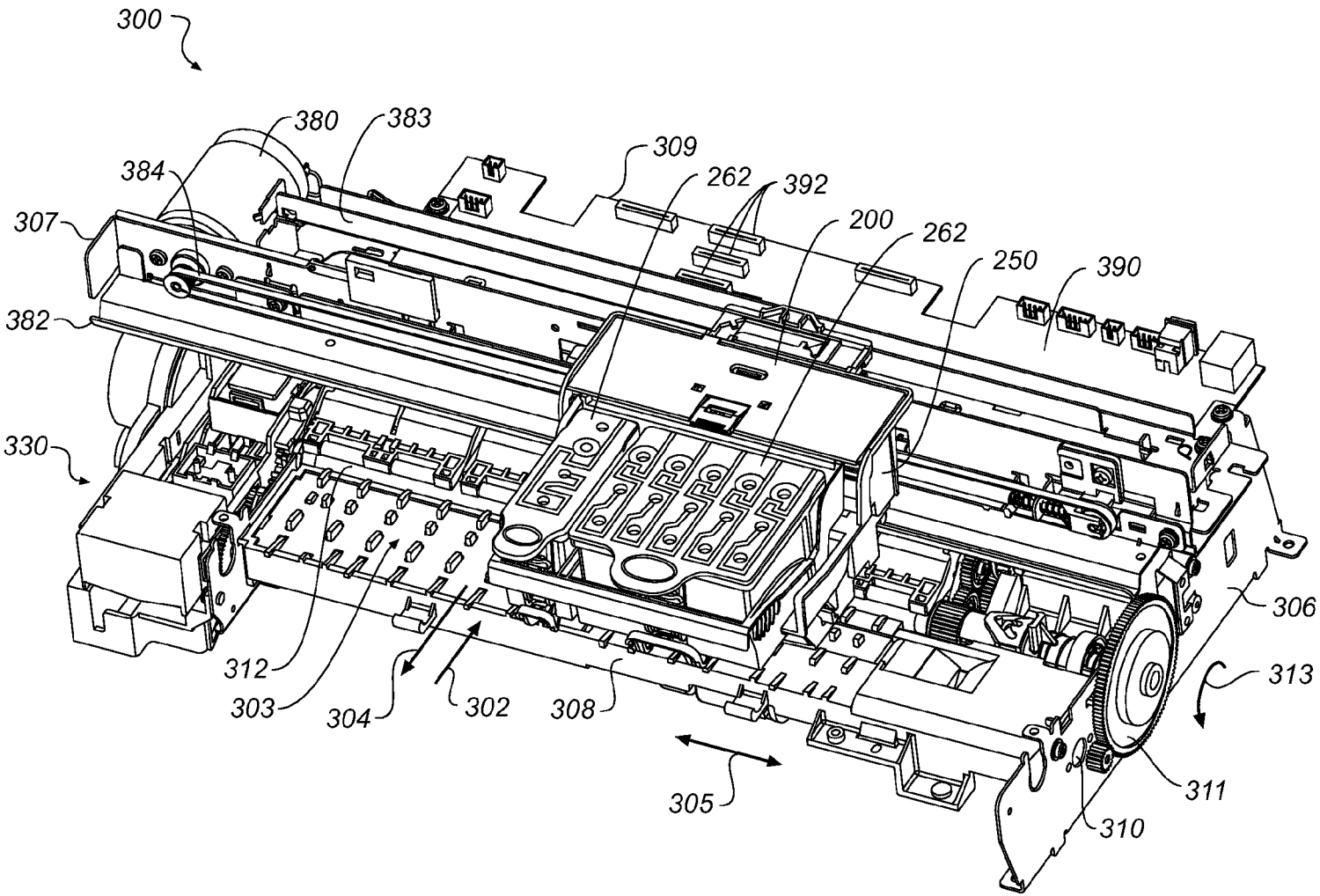
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 between the right side 306 and the left side 307 of printer chassis 300, while drops are ejected from printhead die 251 (not shown in FIG. 3) on print cartridge 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

The mounting orientation of print cartridge 250 is rotated relative to the view in FIG. 2, so that the printhead die 251 are located at the bottom side of print cartridge 250, the droplets of ink being ejected downward onto the recording medium in print region 303 in the view of FIG. 3. Cyan, magenta, yellow and black ink sources 262 are integrated into print cartridge 250. Paper or other recording medium (sometimes generically referred to as paper or media herein) is loaded along paper load entry direction 302 toward the front of printer chassis 308.

Figure 4:
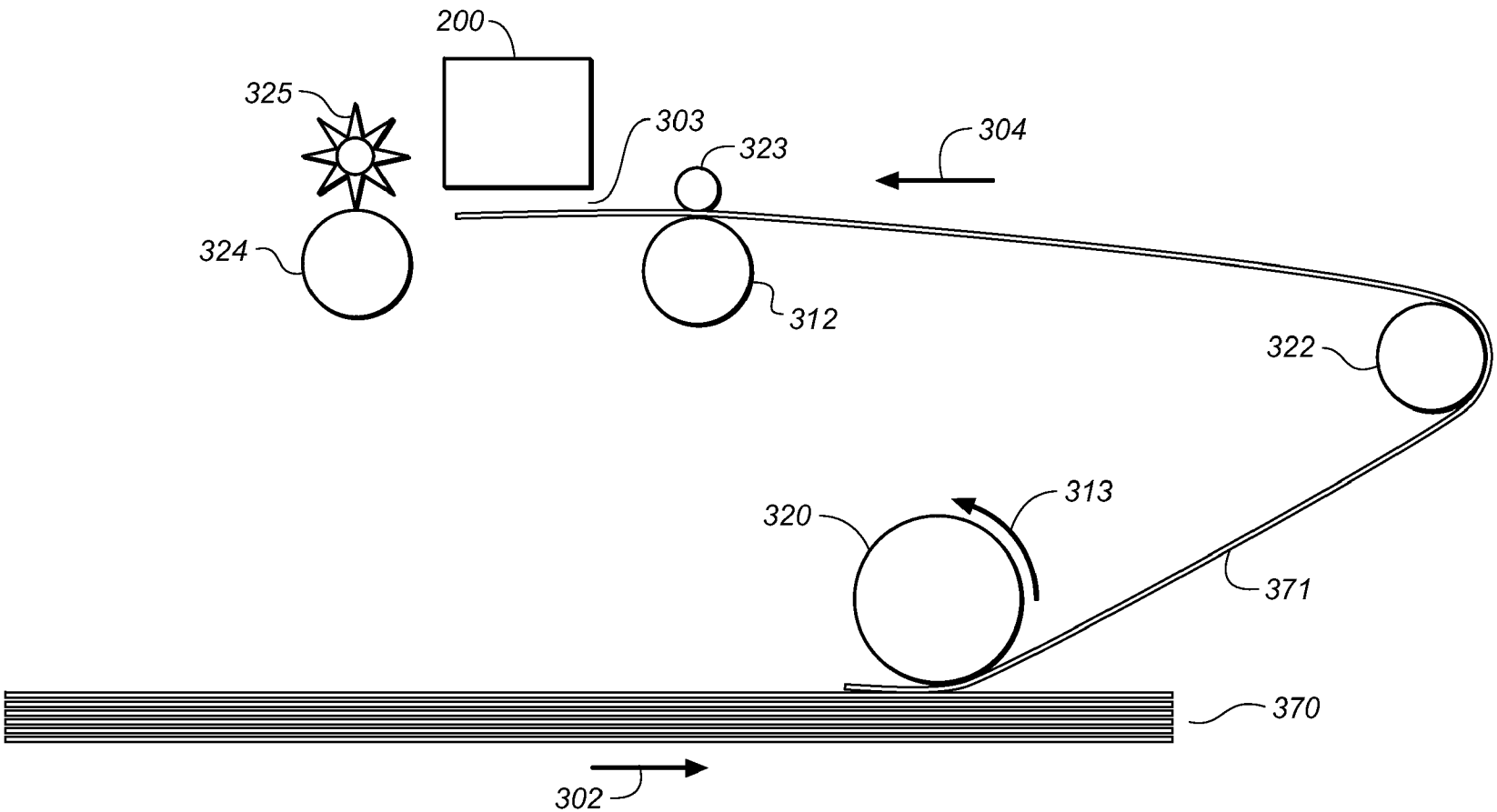
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance across print region 303, and from there to a discharge roller 324 and star wheel(s) 325 so that printed paper exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the printer chassis right-side 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the printer chassis left-side 307, in the example of FIG. 3, is the maintenance station 330.

Toward the printer chassis rear 309, in this example, is located the electronics board 390, which includes cable connectors 392 for communicating via cables (not shown) to the printhead carriage 200 and from there to the print cartridge 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
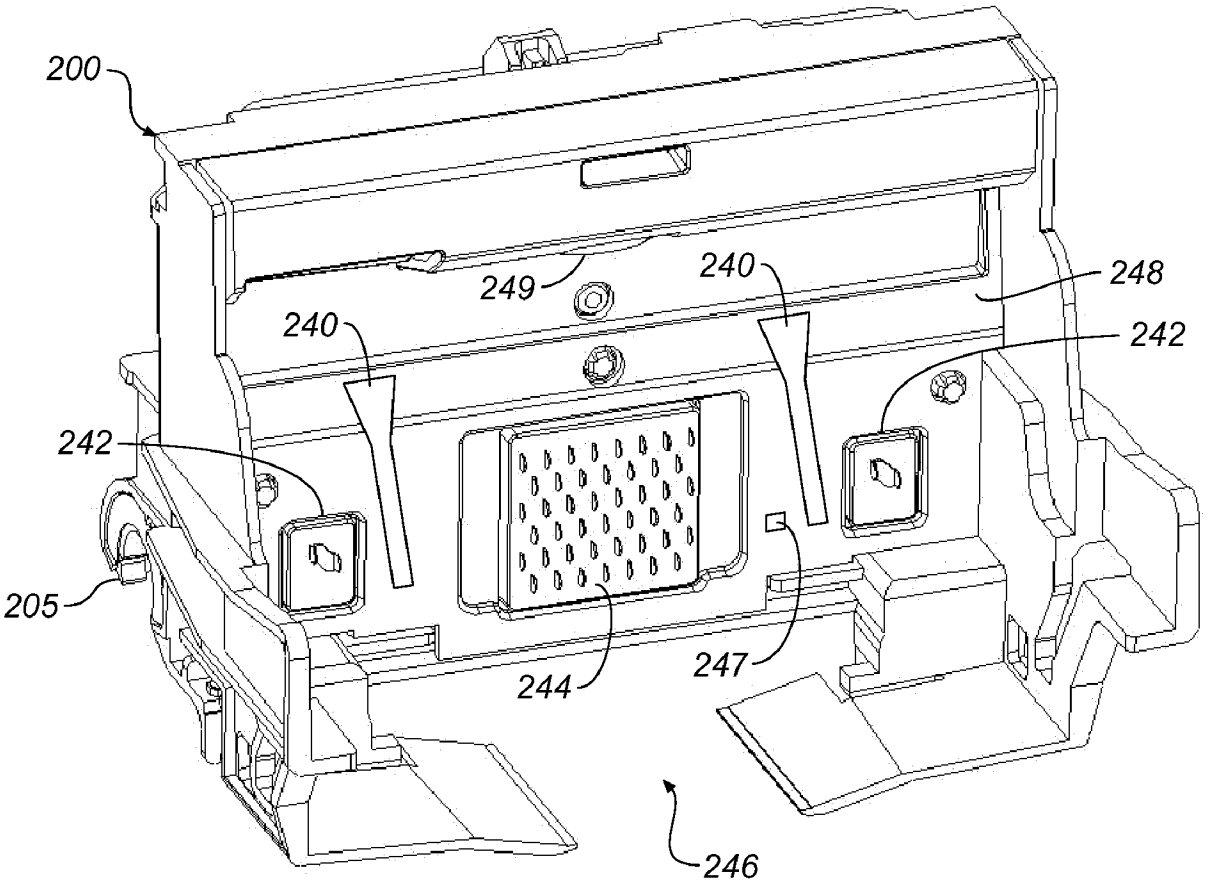
FIG. 5 is a perspective view of a carriage according to an embodiment of the invention.

FIG. 5 shows a perspective view of a carriage 200, according to an embodiment of the invention. In this embodiment, the holding receptacle 246 of carriage 200 receives a print cartridge 250. Printhead electrical connector 244 of carriage 200 mates with connector board 258 when the print cartridge is installed in the carriage. Electrical contacts 267 will mate with electrical connectors 242 in carriage 200 when the print cartridge is properly installed. In some embodiments, electrical contacts 267 are part of a device 266, which can be a data storage device (i.e. a memory device) or circuit for storing and providing information relative to the print cartridge. In other embodiments device 266 can be a different type of electronic device, or even just one or more passive electrical contacts 267 in order to complete a print cartridge detection circuit when they make electrical connection with electrical connector 242. Wall 248 of holding receptacle 246 of carriage 200 includes leaf springs 240, which serve to hold the electrical contacts (including those on connector board 258) of the print cartridge out of contact with printhead connector 244 and electrical connectors 242 until the print cartridge 250 is properly installed and lip 259 (see FIG. 2) is latched by latch 249. In addition to leaf springs 240 being disposed on wall 248, electrical connectors 242 and printhead connector 244 are also disposed on wall 248. Engagement feature 268 (see FIG. 2) of print cartridge 250 optionally engages a leaf spring 240 to suitably hold electrical contacts 267 away from electrical connector 242 until the print cartridge 250 is completely installed into carriage 200. Print cartridge 250 is prevented by spring 240 from reaching a position where the electrical contacts 267 are able to make connection with electrical connector 242. Thus the printer controller 14 will not falsely detect that the print cartridge 250 has been properly installed. The printer will not continue with father operations until the user manually pushes print cartridge further so that it is latched by latch 249, and thus properly installed and electrical contacts 267 make connection with electrical connector 242. The motivation for the spring 240 is to protect against print cartridge misalignment, as well as intermittent electrical connection that can result in poor print quality or even damage to the printhead die 251 for an incorrectly installed print cartridge 250. In some embodiments spring 240 is a compression spring mounted on wall 248 of holding receptacle 246 rather than a leaf spring. Also shown in FIG. 5 is a carriage bushing 205 where carriage 200 makes contact with the carriage guide rail 382 of FIG. 3.

In another embodiment spring 240 is part of a microswitch. Rather than print cartridge 250 detection relying upon electrical connection between electrical contacts 267 and electrical connector 242, in this embodiment detection of an installed print cartridge occurs when the spring is sufficiently displaced by the print cartridge 250 that a microswitch (e.g. leaf spring 240) closes against an optional switch contact 247 and completes a circuit, as shown in FIG. 5.

In summary, the invention resides in an inkjet carriage that receives a print cartridge, the inkjet carriage having a holding receptacle having a wall, wherein the holding receptacle is configured to receive the print cartridge; and a spring disposed on the wall of the holding receptacle to provide a biasing force in a direction that pushes the print cartridge away from the wall of the inkjet carriage and which biasing force must be manually overcome in order to properly install the print cartridge in the holding receptacle of the inkjet carriage.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First ink source
19 Second ink source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
205 Carriage bushing
240 Spring
242 Electrical connector
244 Printhead electrical connector
246 Holding receptacle (for print cartridge)
247 Switch contact
248 Wall
249 Latch
250 Print cartridge
251 Printhead die
253 Nozzle array
254 Nozzle array direction
255 Mounting substrate
256 Encapsulant
257 Flex circuit
258 Connector board
259 Lip
262 Ink sources
266 Device

267 Electrical contact
268 Engagement feature
275 Rear Wall
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors

The invention claimed is:

1. An inkjet printer comprising:

(a) a carriage that receives a print cartridge, the carriage comprising:

(i) a holding receptacle having a wall, wherein the holding receptacle is configured to receive the print cartridge; and (ii) a spring disposed on the wall of the holding receptacle to provide a biasing force in a direction that pushes the print cartridge away from the wall of the holding receptacle and which biasing force must be manually overcome in order to properly install the print cartridge in the holding receptacle of the carriage;

(b) an electrical connector for making electrical connection with an electrical contact of the print cartridge;

(c) a controller electrically connected to the electrical connector; and (d) a microswitch including an open position and a closed position, wherein when the print cartridge is properly installed in the holding receptacle of the carriage, the microswitch is in its closed position, and wherein when the print cartridge is not properly installed in the holding receptacle of the carriage, the microswitch is in its open position.

2. The inkjet printer of claim 1, wherein the spring is a leaf spring.

3. The inkjet printer of claim 1, wherein the spring is a compression spring.

4. The inkjet printer of claim 1 further comprising a latch to hold an installed print cartridge in the holding receptacle of the carriage when the latch is engaged.

5. The inkjet printer of claim 4, wherein, when the latch is engaged, the print cartridge is located at a first position, and wherein, when the latch is not engaged, the spring prevents the print cartridge from reaching the first position.

6. The inkjet printer of claim 1, wherein the print cartridge further comprises a memory device that is connected to the electrical contact.

7. The inkjet printer of claim 1, wherein the print cartridge includes an engagement feature for engaging the spring.

* * * * *